United States Patent [19]

Babikian

[11] Patent Number: 4,909,008

[45] Date of Patent: Mar. 20, 1990

[54] DIAGONAL GRIP BLOCK

[75] Inventor: Sarkis S. Babikian, 22-16 41st St., Astoria, N.Y. 11105

[73] Assignee: Sarkis S. Babikian, Astoria, N.Y.

[21] Appl. No.: 362,687

[22] Filed: Jun. 7, 1989

[51] Int. Cl.[4] ..... E04B 2/14

[52] U.S. Cl. ..... 52/405; 52/587; 52/596; 52/604; 52/608

[58] Field of Search ..... 52/608, 604, 596, 587, 52/405

[56] References Cited

U.S. PATENT DOCUMENTS

| | | | |
|---|---|---|---|
| 2,304,196 | 12/1942 | Oakley | 52/608 |
| 2,645,114 | 7/1953 | Amirikian | 52/587 X |
| 4,206,577 | 6/1980 | Moriez et al. | 52/596 X |
| 4,614,071 | 9/1986 | Sams et al. | 52/405 X |

FOREIGN PATENT DOCUMENTS

| | | | |
|---|---|---|---|
| 886690 | of 1934 | France | 52/604 |
| 405479 | of 1934 | United Kingdom | 52/587 |

*Primary Examiner*—David A. Scherbel
*Assistant Examiner*—Lan Mai

[57] ABSTRACT

The Diagonal Grip Block of the present invention includes a reinforcing metal interwoven screen with "U" shape diagonal cut. Both ends are parallel in slant, cast in a concrete mixture. The metal screen protrudes from the limit of the concrete cast, forming vee shaped pins on the sides and bottom when contacting each other on a concrete surface. The vee shaped pins define the mortar thickness with a perfect bond. The core of the "U" shape is filled with insulation to alleviate the tension of the expansion and to moderate the temperature of the whole construction. This will also help the absorption of sound waves.

8 Claims, 7 Drawing Sheets

DIAGONAL GRIP BLOCK

BACKGROUND OF THE INVENTION

The instant invention relates generally to construction block. more specifically, it relates to a Diagonal Grip Block. Numerous blocks have been provided in prior art that are adapted for use in building construction by U.S. Pat. Nos. 672,176; 722,237; 1,521,430; 1,649,780; 2,234,797; 4,614,071; 4,040,225; 4,107,894; 4,372,091; 4,426,815; 4,441,298; 449,485; 645,279; 401,557; 4,016,693; 4,550,543; 4,510,725; 4,527,373; and 4,597,236 as documented. While this unit may be suitable for the purpose of the present invention, as heretofore described.

SUMMARY OF THE INVENTION

The primary objective of the present invention is to provide a Diagonal Grip Block that will overcome the limitation of prior art devices. Its contents is made of a blend of crushed stone fragments sand or stone dust, water and cement, as a concrete mixture. The block has a rhombic configuration with the sides being cut diagonally and parallel to each other. The exterior of the Diagonal Grip Block is angular, the interior of the core is essentially, "U" shaped forming a cavity to be filled with insulation. There is a reinforcing layer of interwoven metal screen placed with the concrete shell, the ends of which screen protrude from the edges of the concrete shell forming angularly related pairs of pins.

Further, this invention includes, but does not limit the Diagonal Grip Block being light in weight, stable in construction, offering security from breakdowns, limiting temperature changes due to the inner insulation, ease of application, eliminating the cost of additional materials, etc.

Another objective is the restriction in the use of such material as; lintels for doors, windows, openings and wood molds for beams and footing.

An additional objective is, the Diagonal Grip Block with its unique angular griping shape or form, is the ideal for the laying of foundations. The Diagonal Grip Blocks are laid in the reverse position, alternating the diagonal, forming a lateral dental grip. The normal pressure of a foundation is the bottom, added by the extra lateral grips, prevent the construction from loosening without the need for footings.

Another objective is that the Diagonal Grip Block, with its vee shape metal pins protruding from the concrete cast, intermesh when they are corrected or joined with another Diagonal Grip Block. These pins also act as block spacers and allow the mortar to form a uniformed thickness diagonally and the bottom.

A further objective is that the Diagonal Grip Block divided its own weight when it is joined to the accompanying obtuse angle. These angular diagonal joints, with their vee shape metal pins, will meet with the opposite sides forming a complete and secure bond. The reinforcing interwoven metal screen, of the Diagonal Grip Block, becomes a "U" shape beam in each row by interlacing to each other. As unseen double fence is created between the inner and the outer sides of the construction.

Further, the Diagonal Grip Block, with the insulation built within, prevents the mortar excess, or mortar drops, from accumulating in the core. This alleviates the tension of the expansion, moderating the temperature between the inside and outside of the construction. It helps the absorption sound waves.

Yet another objective of the Diagonal Grip Block when is used as a platform, abreast and aligned in the reverse position, with the angle in one direction and steel rods are placed in between the Diagonal Grip Block, the rods are connected wall-to-wall. When the concrete mixture is cast, the walls and platform interlace, joining as one. The platform becomes lighter by using the insulated Diagonal Grip Block. There is less hazard to fire, as wood enforcement are eliminated.

Another objective of the Diagonal Grip Block, in its ingenious style of artistic endeavor, is that it creates many varied crosshatch or oblique designs for facade decoration, the Diagonal Grip Block is light in weight for a purpose:

1. The concrete enforcement in the center is eliminated and replaced with insulation.
2. The concrete is eliminated on three sides, the ends and bottom.
3. Ease in the handling by the construction worker.

Additionally, when the Diagonal Grip Block is laid in each row, some being placed in the reverse position, the content of the entire construction is practically chained together. It could crack but will hang on to each other having less chances of falling apart, as the metal screens go into action to support the construction under unexpected vibrating circumstances.

To accomplish the above, this invention is embodied in the form of the accompanying drawings. These are some of the many examples of how this invention, using the Diagonal Grip Block, may be used. Its application and use are numerous.

BRIEF DESCRIPTION OF THE DRAWING FIGURES

FIG. 1 features the complete invention of the Diagonal Grip Block depicting the concrete shell, metal screens, vee shaped metal pins, insulation and mortar excess gap.

DETAILED DESCRIPTION OF THE PREFERRED EMBODIMENTS

Figure 1:
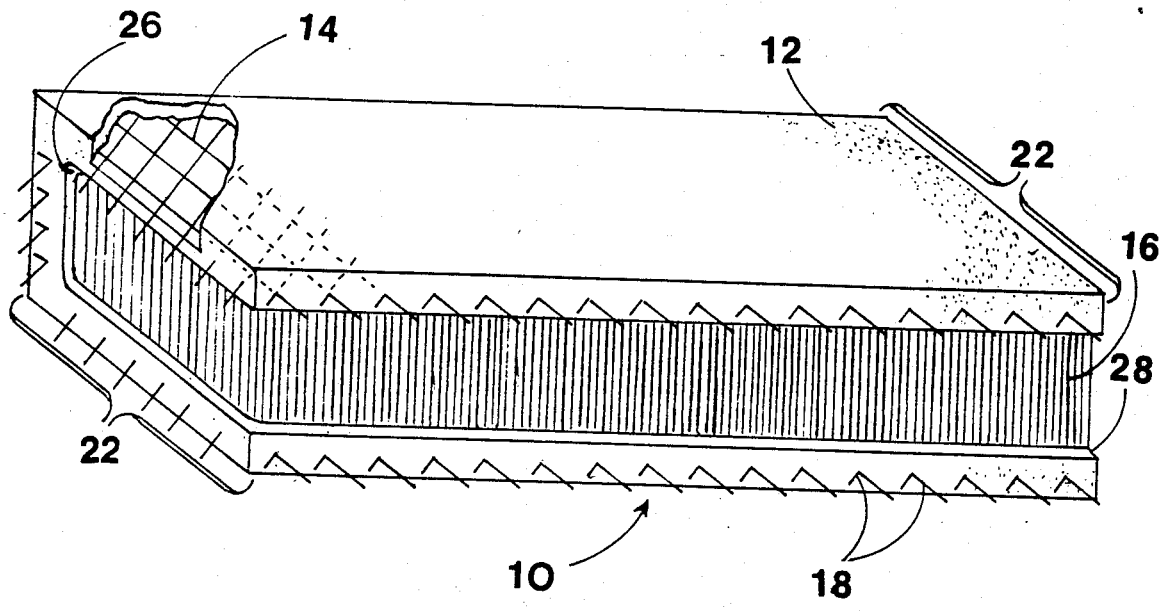

The Diagonal Grip Block or the D.G.B. has a unique rhombic configuration as shown in FIG. 1. The reinforcing metal screen #14, is incorporated within the concrete shell #12. The core of the D.G.B. forms a "U" shape. In this center insulation an #16 layer is installed. The insulation #16 fills the hollow or "U" shape of the D.G.B. forming a small guide shaft as a gap #28 around the open sides. The guide shaft #28 acts as the inner limit for the excess mortar to release itself. The D.G.B. within metal screen #14 forms vee shaped metal pins #18 protruding from the edges of the concrete shell #12.

FIG. 1 shows the D.G.B. in its complete stage, represented by #10. It includes the concrete the shell #12; interwoven unseen metal screen #14; the vee shaped metal pins #18; the insulation #16; the mortar excess gap or guide shaft #28; and the diagonal shape #22.

Figure 2:
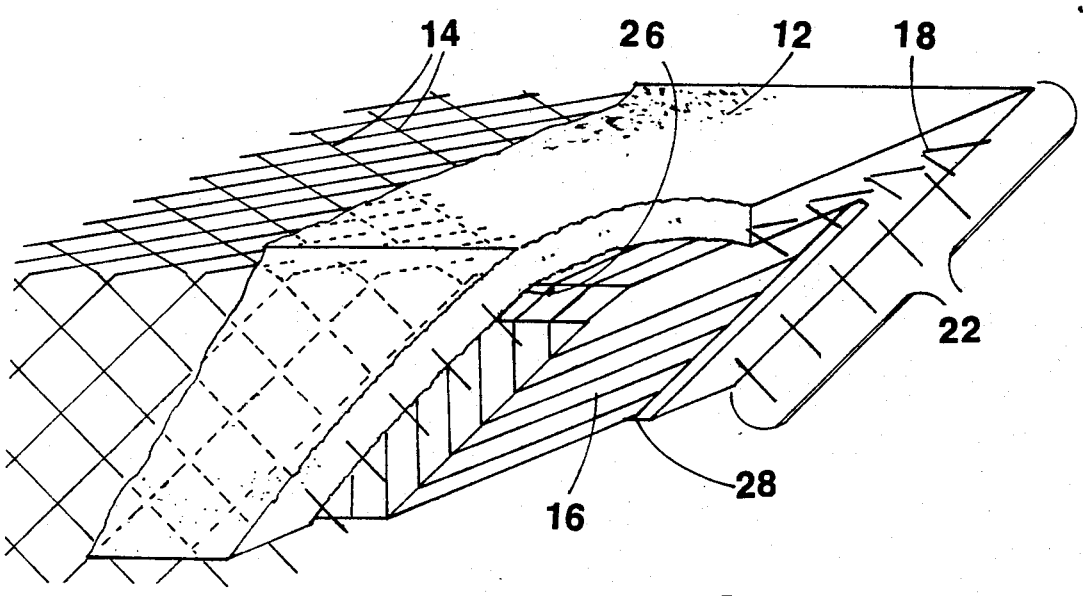
FIG. 2 is a sectionalized side view cutout of the Diagonal Grip Block.

FIG. 2 shows a sectionalized side view cutout depicting both the inner and the outer view of the D.G.B., defining the FIG. 1 content.

Figure 3:
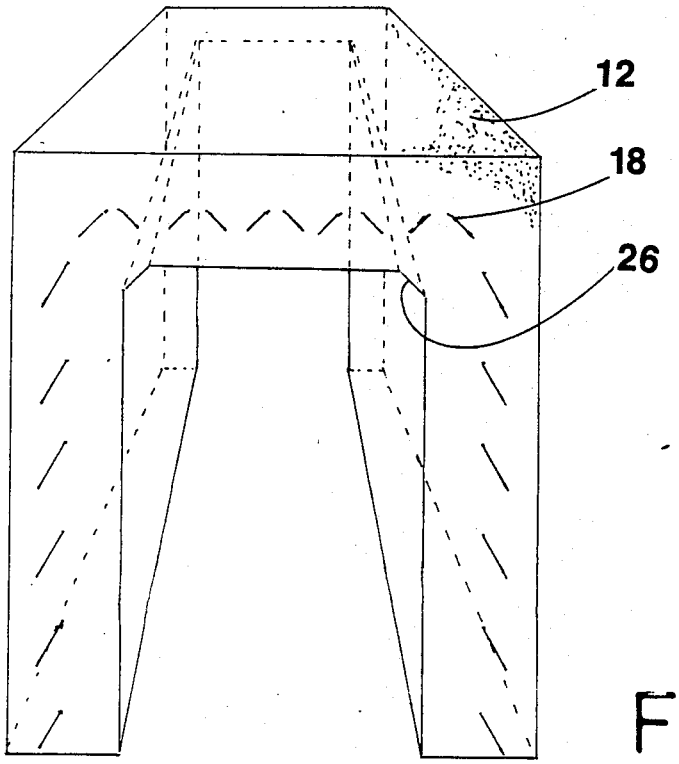
FIG. 3 is a view of the invention, without insulation.

FIG. 3 is an end view showing an extra thickness of enforcement #26 in the inner corners of the "U": shape on the two vertical walls and the horizontal plane. No insulation is shown.

Figure 4:
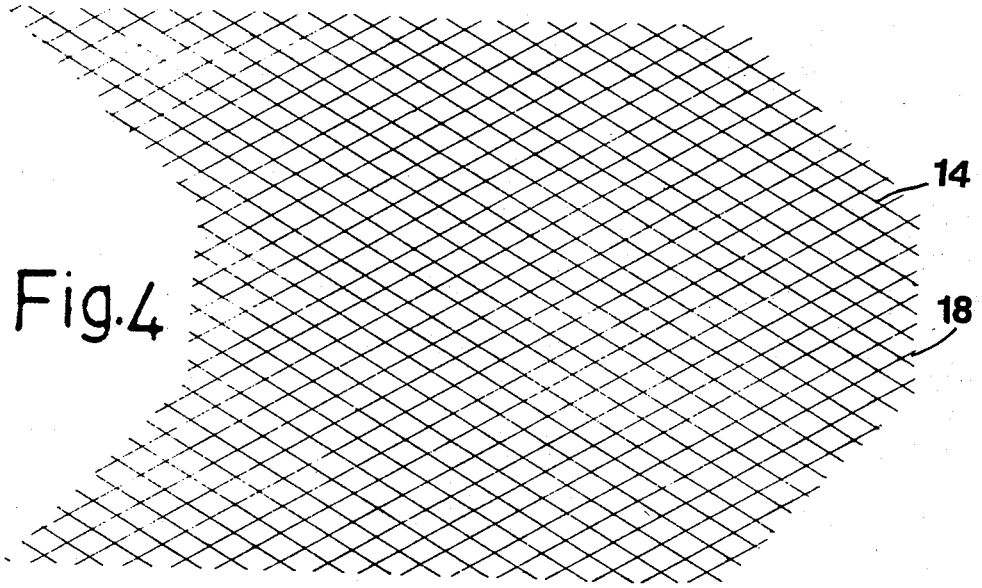
FIG. 4 is the flat cut of the metal screen lozenge aperture diamond shape.
Figure 5:
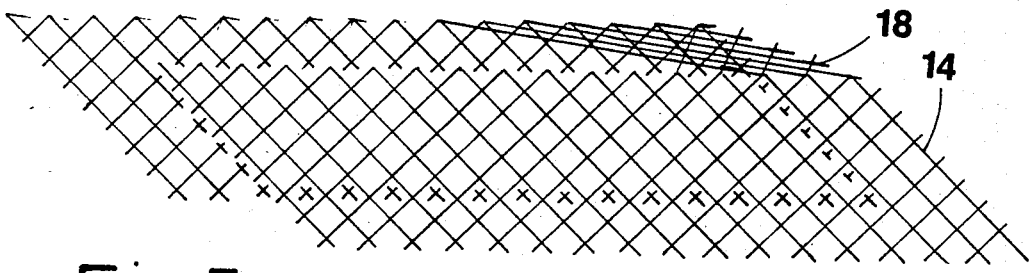
FIG. 5 is the metal screen in a "U" shape, used as a amarture.
Figure 6:
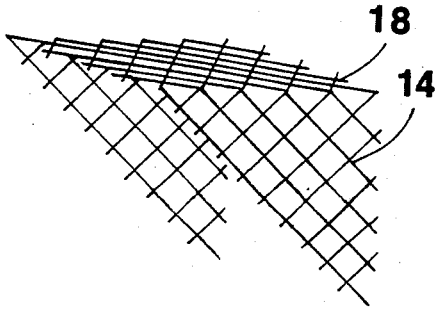
FIG. 6 is the metal screen as an armature for the triangle cap.

FIGS. 4,5,6,8 and 10 are the reinforcing layer of metal screen, expandable sheet metal having lozenge openings can be used as seen in FIG. 4.

Figure 7:
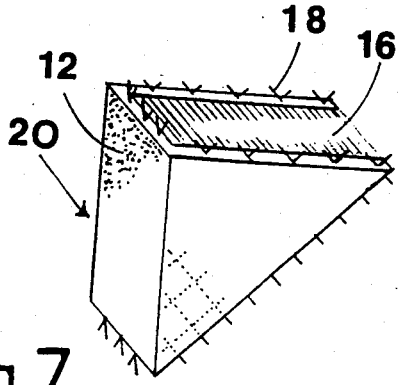
FIG. 7 represents a ready made triangle cap.
Figure 8:
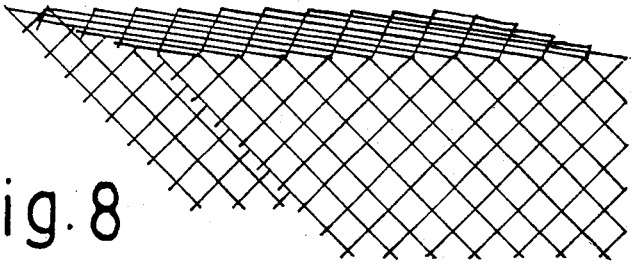
FIG. 8 is the metal screen armarture for a half size Diagonal Grip Block with one end at right angle, and the other as a diagonal.

FIG. 7 represented by #20, shows a ready made triangle cap, without the gap or guide shaft, in the concrete cast #12; the interwoven unseen metal screen #14; the protruding vee shaped metal pins #18; and the insulation #16; and it is optional.

Figure 9:
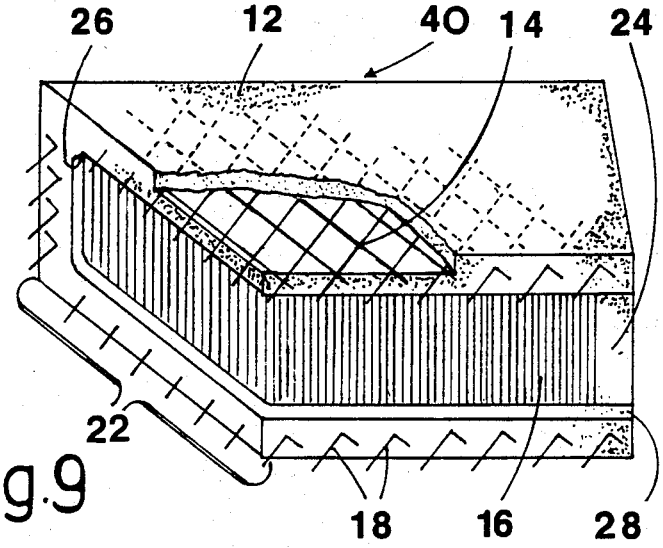
FIG. 9 is the complete stage of a half size Diagonal Grip Block, with one side as a diagonal and the other at a closed right angle.
Figure 10:
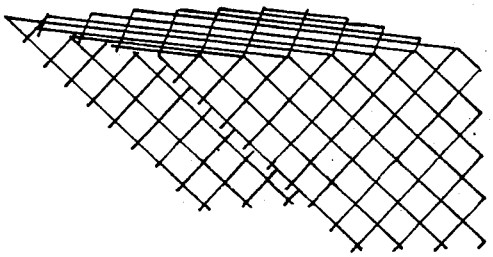
FIG. 10 is the metal screen armature for a quater size Diagonal Grip Block with one end at a right angle and the other as a diagonal.

FIG. 9 represented by #40, is the complete stage of a half size D.G.B. One side is a diagonal #22; and the other at a close right angle with no metal screen in the concrete cast #24; the mortar excess gap or guide shaft #28; the vee shaped metal pins #18; and the insulation #16; for plumb finihing and is optional.

Figure 11:
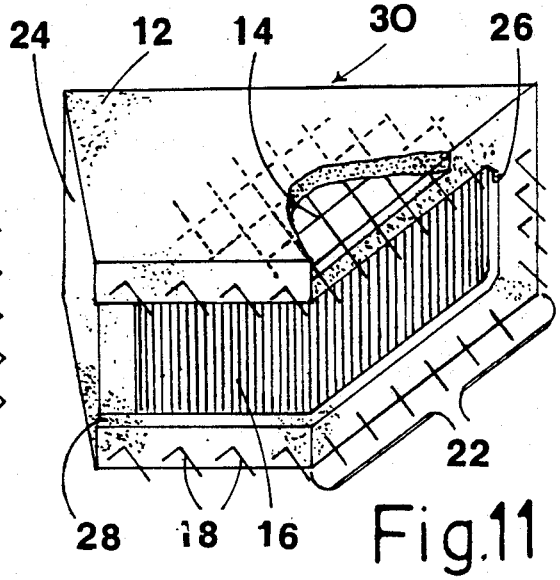
FIG. 11 is the complete stage of a quater size Diagonal Grip Block with one side as a diagonal and the other at a close right angle.

FIG. 11 represented by #30, is the complete stage of a quarter size D.G.B. One side is a diagonal #22; and the other at a closed right angle with no metal screen in the concrete cast #24; the mortar excess gap or guide shaft #28; the vee shaped metal pins #18; and the insulation #16; is the plumb finishing and is optional.

Figure 13:
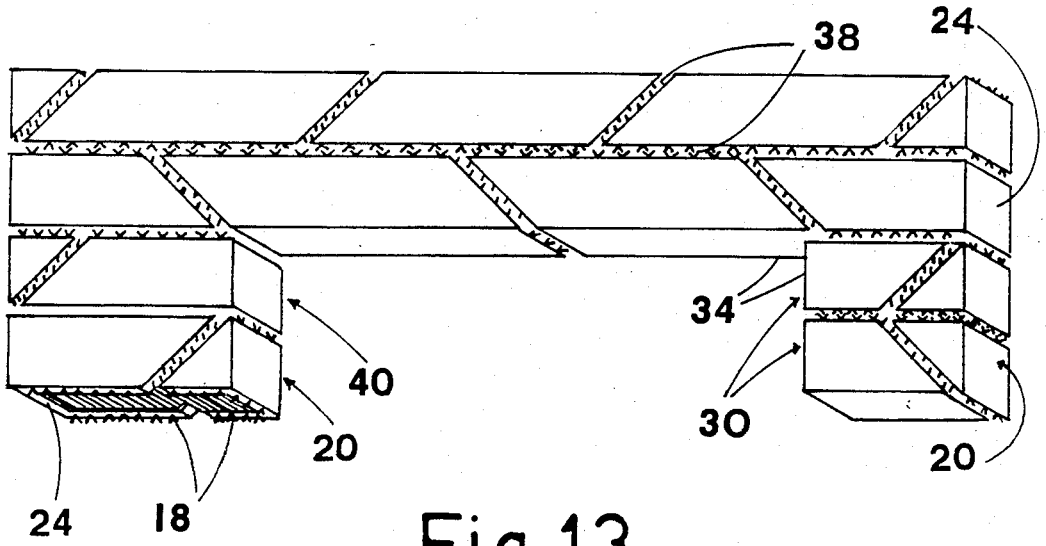
FIG. 13 illustrates an opening without the use of lintels, the Diagonal Grip Block is used in reverse position.

FIGS. 7, 9 and 11 are accompaniments for variations in design and plumb finish, as illustrated in FIG. 13, by incorporating a ready made cap #20; with quarter size D.G.B. #30, it forms a thin column. The half size D.G.B. 40 with the cap #20, forms a thicker column. Different size columns and designs can be created.

Also the FIGS. 7, 9 and 11 are optional, reason; could be cut from a whole D.G.B. to accomplish any finishing.

Figure 12:
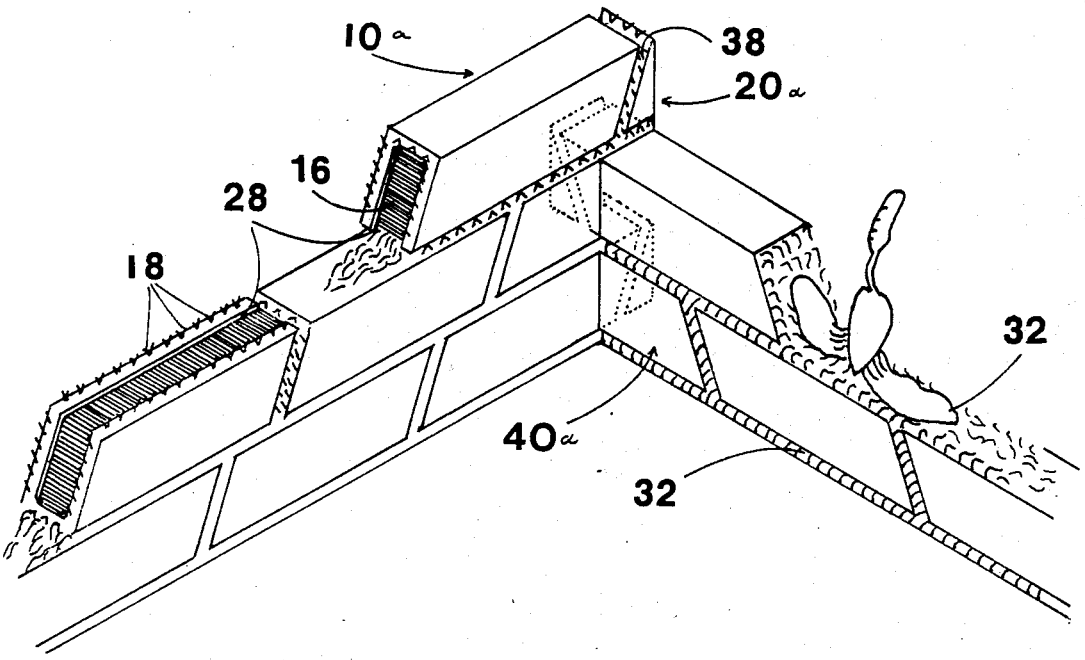
FIG. 12 illustrates the spreading of the mortar on an obtuse angle.

FIG. 12, shows the facility at which the mortar is spreaded on the obtuse angle, where it grips onto the vee shaped metal pins #18, and the insulation #16 supports the mortar #32, when the next D.G.B. #10a is placed on the mortar #32 and pressed; the vee shaped metal pins #18 will act as block spacer by intermeshing each other and limiting their distance to the contacting surface. The excess mortar #32 is released by the gap or the guide shaft #28, and from the angular pins aperture. This will, in effect, produce a uniformed thickness of mortar #32 at the ends and the bottom.

FIG. 13 shows the D.G.B. #10, in reverse position #34, for an opening. Additional strength comes from the intermeshing #38 of the two sets (upper and lower) of vee shaped metal pins #18 within the mortar. It then transforms to a double height beam, finished openings are ready made for installing doors, windows, etc.. The D.G.B. will eliminate lintels or the need of any wooden forms for concrete beam castings. Once the mortar #32 has dried the temporary supports are removed. Different column widths can be built using the half size D.G.B. #40 and the cap #20 or the quarter size D.G.B. #30 and cap #20 in a plumb finish, in the standard or reverse position #34.

Figure 14:
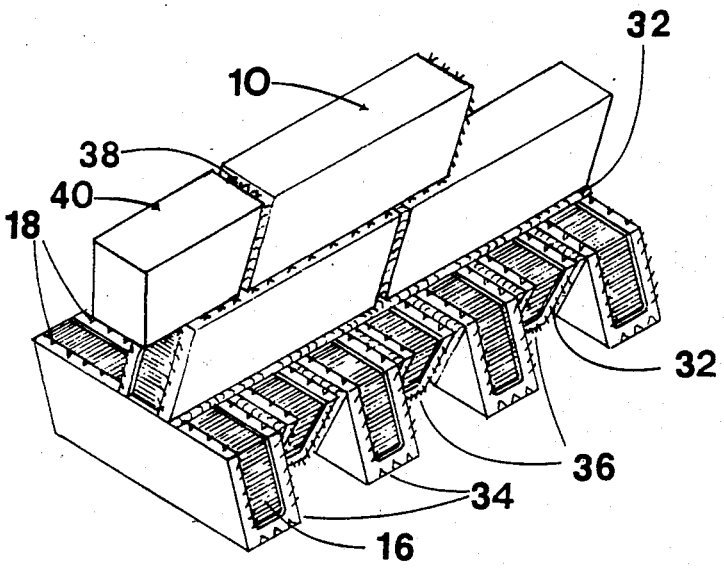
FIG. 14 illustrates a foundation base in reversed and abreast.

FIG. 14 shows the D.G.B., with its ingeneous form, in its reverse position #34, laid withdiffering diagonal positions. The D.G.B. #10 rests on the surface, the diagonal slants up, the adjacent D.G.B. #10 is abreast and its angle is in opposite direction #36, then covered with mortar #32 to protect the vee shaped metal pins #18 and the insulation #16, forming a dental grip laterally which can be repeated, row upon row, as foundation requires, always in opposite angles #34, #36. This foundation becomes spiny, so is held from the bottom, as usual, and has an extra lateral grip. This foundation makes minute depressions on any soft, sandy ground or muddy, damp soil.

Figure 15:
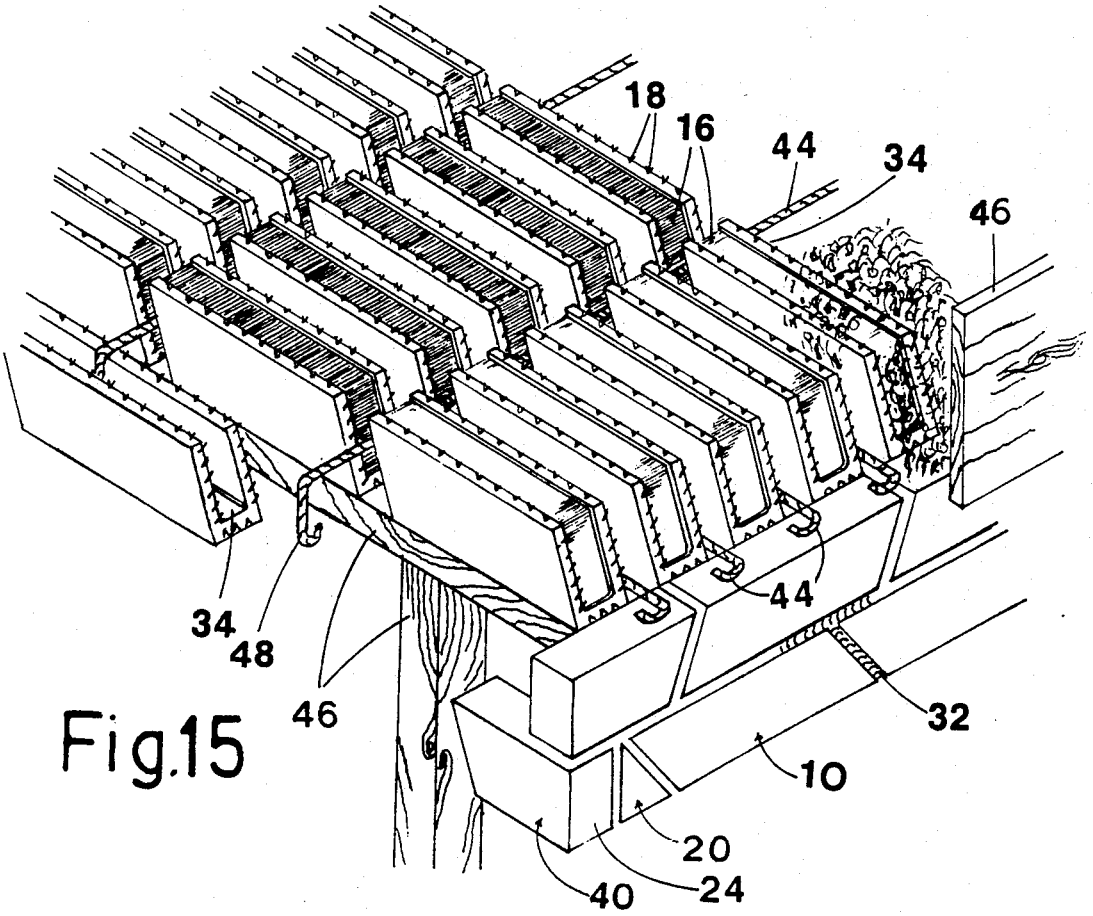
FIG. 15 illustrates the Diagonal Grip Block on temporary wooden supports, to cast a platform.

FIG. 15 shows a wooden temporary support #46, leveled to a desired height. The D.G.B. #10 is abreast in the reverse position #34. Inbetween each D.G.B., a steel rod #44 is laid and extended wall-to-wall, or the rod is emerged in the core of the "U" shape in the reverse position as #48, to cast with a concrete mixture in order to form a flat surface. Once it has dried, the temporary wooden supports #46 can be removed. This platform becomes very strong and light weight. When platform FIG. #15 is placed on ground leveled, spiny lateral, foundation FIG. #14, which can be built into any muddy or damp soil, becomes a sturdy base.

Figure 16:
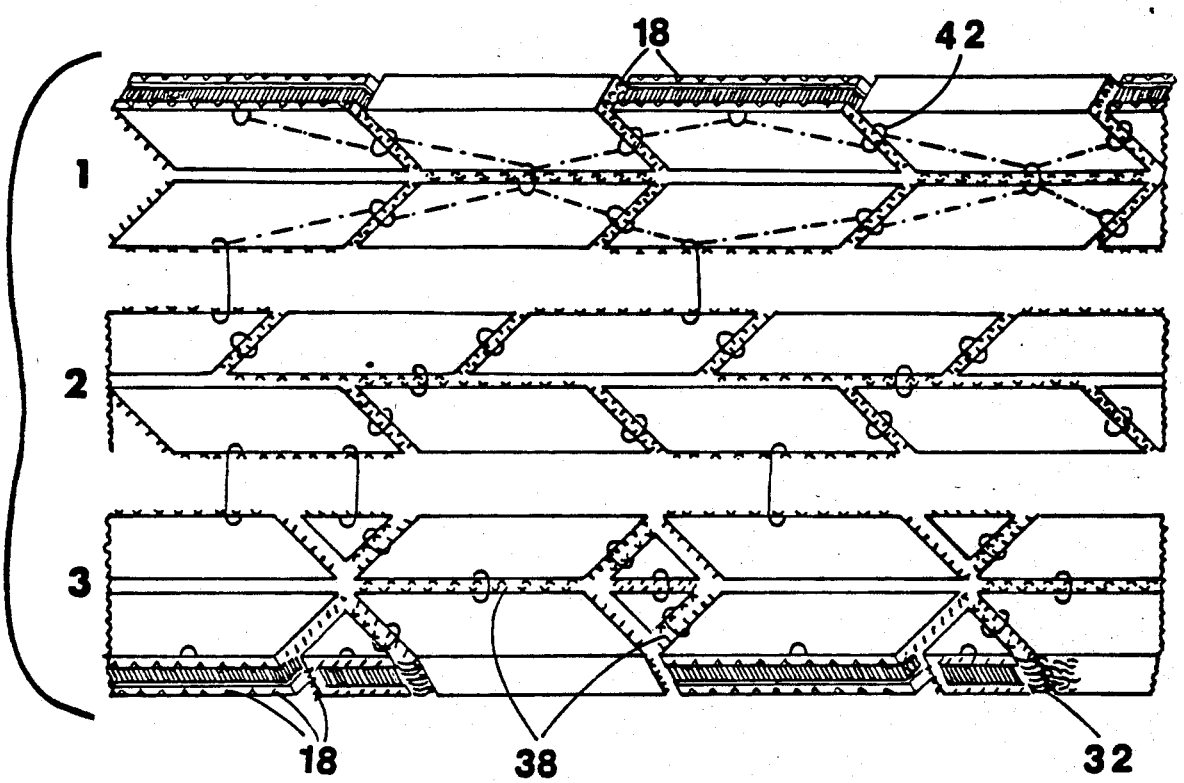
FIG. 16 illustrates a three type of a crosshatch or oblique facade designs as A.B.C.

FIG. 16 shows several varied designs A, B, and C of the D.G.B. are crosshatch or oblique. Using every other D.G.B. in reverse position in each row, gives additional strength to each upper row. This interlacing forms a chain effect, diagonally, to upper and below rows, #42. The vee shaped metal pins #18 are interlaced #38 in the mortar #32.

Figure 17:
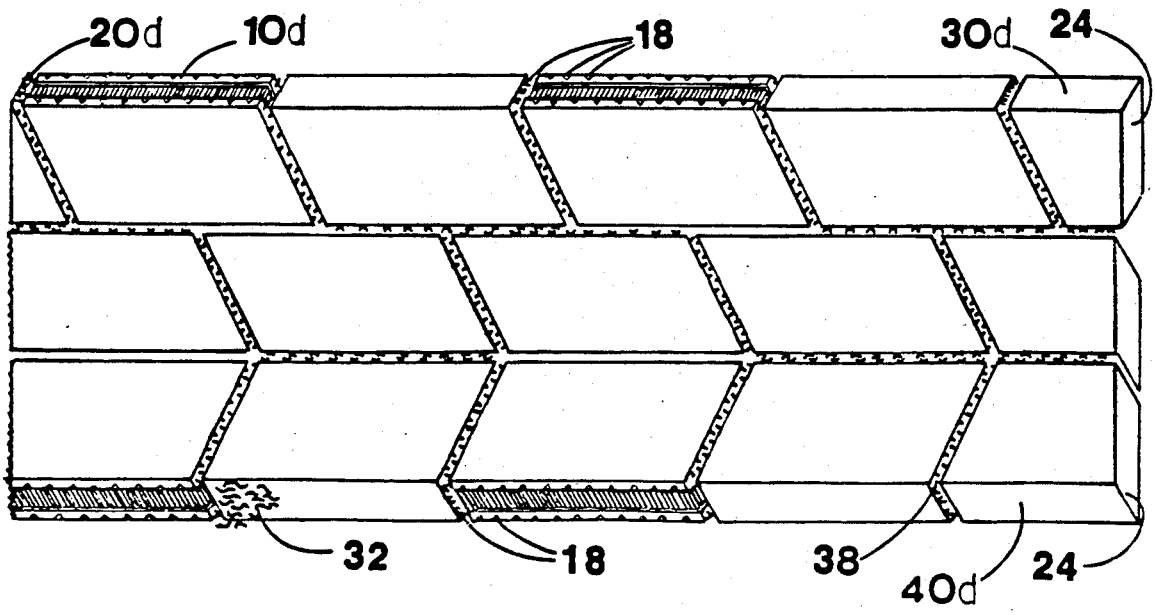
FIG. 17 illustrates the use of double height Diagonal Grip Block.

FIG. 17 shows a double height of D.G.B. in oblique design. The vee shaped metal pins #18 are interlaced #38 in the mortar #32. NOTE: FIGS. 16 and 17 shows the versatility of the D.G.B. Many combinations can be created for facade design.

While certain novel features of this invention have been shown and described, it will be understood that various omissions, substitutions and changes in the forms and details of the device illustrated, and in its operation, can be made by those skilled in the art without departing from the spirit of invention.

What is claimed is:

1. A rhombic grip block comprising a concrete shell, an insulation layer and a reinforcing layer;

said concrete shell formed with a U-shaped cross section with a pair of parallel rhombic side faces connected at their bottom edges by a base portion, said reinforcing layer formed as a U-shaped metal screen embedded in the concrete shell with portions of the screen extending beyond the top and side edges of the rhombic side faces forming pins, said pins forming angularly related pairs of pins extending from the top edges of the rhombic side faces and further pins extending from the side edges of the rhombic side faces, said insulation layer comprised of a rhombic body disposed between the rhombic side faces and base portion with a top edge and side edge of the rhombic body recessed from the top and side edges of the said rhombic side faces, whereby the blocks are assembled adjacent to each other, the pins act as block spacers and mortar is spread in the spaces formed between adjacent blocks.

2. A rhombic grip block of claim 1 wherein said reinforcing layer is made of expandable sheet metal forming lozenge openings.

3. A rhombic grip block of claim 1 wherein the recess in said insulation layer acts as a retaining cavity for the mortar between said rhombic side faces of the block.

4. A rhombic grip block of claim 1 wherein said pins are interlaced and embedded in mortar in obtuse angle.

5. A rhombic grip block of claim 1 whereby said blocks being laid side by side laterally to form a foundation without column footings.

6. A rhombic grip block of claim 5 whereby said block being laid head to head.

7. A rhombic grip block of claim 5 whereby said laid blocks present a finishing facade with crosshatch design.

8. A rhombic grip block of claim 5 whereby every other one of said block being laid in reverse position in a row links the entire construction.

* * * * *